United States Patent [19]

Whitehead et al.

[11] Patent Number: 5,056,553

[45] Date of Patent: Oct. 15, 1991

[54] PORTABLE HOSE CART

[75] Inventors: Stephen P. Whitehead; Joseph J. Sanchez, both of Elgin, Ill.

[73] Assignee: Suncast Corporation, Batavia, Ill.

[21] Appl. No.: 564,222

[22] Filed: Aug. 7, 1990

[51] Int. Cl.[5] ..... B65H 75/34

[52] U.S. Cl. ..... 137/355.27; 242/86

[58] Field of Search ..... 137/355.26, 355.27, 137/355.16, 580; 242/86

[56] References Cited

U.S. PATENT DOCUMENTS

| | | | |
|---|---|---|---|
| Re. 32,510 | 9/1987 | Tisbo et al. | 137/355.27 |
| 177,367 | 5/1976 | Bartlett . | |
| 904,380 | 11/1908 | Vader . | |
| 1,227,466 | 5/1917 | McDowell | 137/355.21 |
| 1,441,157 | 1/1923 | Krenke . | |
| 4,137,939 | 2/1979 | Chow | 137/355.27 |
| 4,506,698 | 3/1985 | Garcia et al. | 137/355.16 |
| 4,537,215 | 8/1985 | Roman | 137/355.26 |
| 4,700,737 | 10/1987 | Nelson | 137/355.27 |
| 4,768,546 | 9/1988 | Brusadin et al. | 137/355.17 |
| 4,777,976 | 10/1988 | Johnston et al. | 137/355.27 |
| 4,913,580 | 4/1990 | Whitehead | 403/326 |

FOREIGN PATENT DOCUMENTS

| | | | |
|---|---|---|---|
| 2415596 | 9/1979 | France | 137/355.26 |

*Primary Examiner*—A. Michael Chambers

*Attorney, Agent, or Firm*—Fitch, Even, Tabin & Flannery

[57] ABSTRACT

A portable hose cart comprising first and second frame sides, each having a hub bearing surface. The cart also includes a reel positioned between the frame sides and made up of first and second reel flanges, each having a hub rotatably supported by the hub bearing surface of a corresponding frame side, and a number of cross braces joining the reel flanges and definging a support surface for the winding of the hose. A U-shaped handle is connected to the tops of the first and second frame sides. An axle is releasably held by each frame side adjacent its bottom with the axle and the frame sides functioninbg to maintain the frame sides spaced a predetermined distance to hold the reel. The axle rotatably holds first and second wheels which extend beneath the bottom of the frame side. Furthermore, each frame side adjacent its bottom includes a mounting foot for, after removal of the wheels and the handle, permitting the frame sides holding the reel to be positioned on a wall.

15 Claims, 7 Drawing Sheets

PORTABLE HOSE CART

This invention relates to hose storage apparatus and, more particularly to a portable hose cart which can be converted to a hose reel for wall mounting by removing the wheels and the handle.

BACKGROUND OF THE INVENTION

Portable hose carts for convenient handling and storage of a garden hose have gained wide public acceptance. Such carts, which are chiefly made of molded plastic components, include a rotatable reel for taking up and paying out the hose, a frame including a pair of frame sides for supporting the reel, wheels at one end of the base of the frame, and a handle for tilting the frame onto the wheels so that the cart may be easily moved. For more information concerning the structure and operation of such a hose cart, reference may be made to commonly-assigned U.S. Pat. No. Re. 32,510, the teachings of which are hereby incorporated by reference.

Such portable hose carts are typically not adapted for conversion to wall mounting. The inability to convert the components forming a wheeled hose cart between the hose cart assembly and a wall mounting assembly has disadvantages for both the consumer and the distributor. With respect to the consumer, should it be desired to mount the hose on a wall, the consumer would be required to purchase an entirely new reel assembly because the reel assembly which is part of the portable hose cart owned by the consumer could not be used. With respect to the distributor, a box containing components which could be assembled into either a wheeled portable hose cart or a hose reel assembly for wall mounting is desirable because fewer different types of items would need to be stocked as a purchaser could use the same item to satisfy either need.

As these hose carts are for the general consuming public, it is desirable that the carts can be easily assembled. Commercially available hose carts typically make extensive use of threaded fasteners to join major components. The use of such fasteners can be time consuming and requires the use of a simple hand tool. U.S. Pat. No. 4,913,580, the teachings of which are hereby incorporated by reference, teaches the use of a connector assembly for joining components of a hose cart. A male component of the assembly is molded with one piece of the cart, and a female component of the assembly is molded with a second piece of the cart to be joined to the first piece. These components are easily unlatched to permit disassembly of the hose cart.

U.S. Pat. No. 4,700,737 to Nelson is directed to a hose reel, held by a U-shaped yoke with a dependent arm. This arm can be received either in a bracket assembly held by a portable caddy, or by a wall mounting bracket.

U.S. Pat. No. 1,441,157 to Krenke shows a water outlet tube or pintle which has a flange riveted to the reel end, and which is coaxial with the reel. Furthermore, the hose supporting arms are spaced to permit the user sufficient room to attach the hose fitting to the threaded end of the outlet tube.

U.S. Pat. No. 4,768,546 to Brusadin et al. illustrates a hose winding cart including a pair of identical reel halves with each of the reel halves having a member of a snap connector assembly for interconnecting the reel halves thereby forming a completed reel.

SUMMARY OF THE INVENTION

Among the several aspects and features of the present invention may be noted the provision of an improved portable garden hose cart. The cart includes wheels and a handle assembly, and the cart can be converted to a hose reel assembly for wall mounting by simply removing the wheels and the handle assembly. The conversion between cart and hose reel assembly can be made quickly and easily without a wholesale disassembly of the hose reel. Furthermore, nearly all the components of the cart are used in the hose reel assembly, with the hose reel assembly having sufficient rigidity. Additionally, the hose reel flanges include integral fluid outlet tubes. The cart of the present invention is reliable in use, has long service life, and is relatively economical and easy to manufacture. Other aspects and features of this invention will be, in part, apparent and, in part, pointed out specifically in the following specification and accompanying drawings.

Briefly, a portable hose cart embodying various aspects of the present invention is convertible to a hose reel assembly for mounting on a wall. The hose cart includes first and second frame sides each including a hub bearing surface. The cart also includes a reel positioned between the frame sides and including first and second reel flanges, each having a hub supported by a hub bearing surface of a corresponding frame side, and a plurality of cross braces joining the reel flanges and defining a support surface for the hose. A handle joins the tops of the frame sides and an axle is releasably held by each frame side adjacent the bottom thereof. The axle and the frame sides include means for maintaining the frame sides spaced a predetermined distance. The cart also includes first and second wheels rotatably held by the axle with the wheels extending beneath the bottom of the frame side. Each frame side adjacent its bottom includes means for mounting the frame sides holding the reel on a wall after the wheels have been removed.

BRIEF DESCRIPTION OF THE DRAWINGS

Corresponding reference numerals indicate corresponding components throughout the several views of the drawings.

DESCRIPTION OF THE PREFERRED EMBODIMENT

Figure 1:
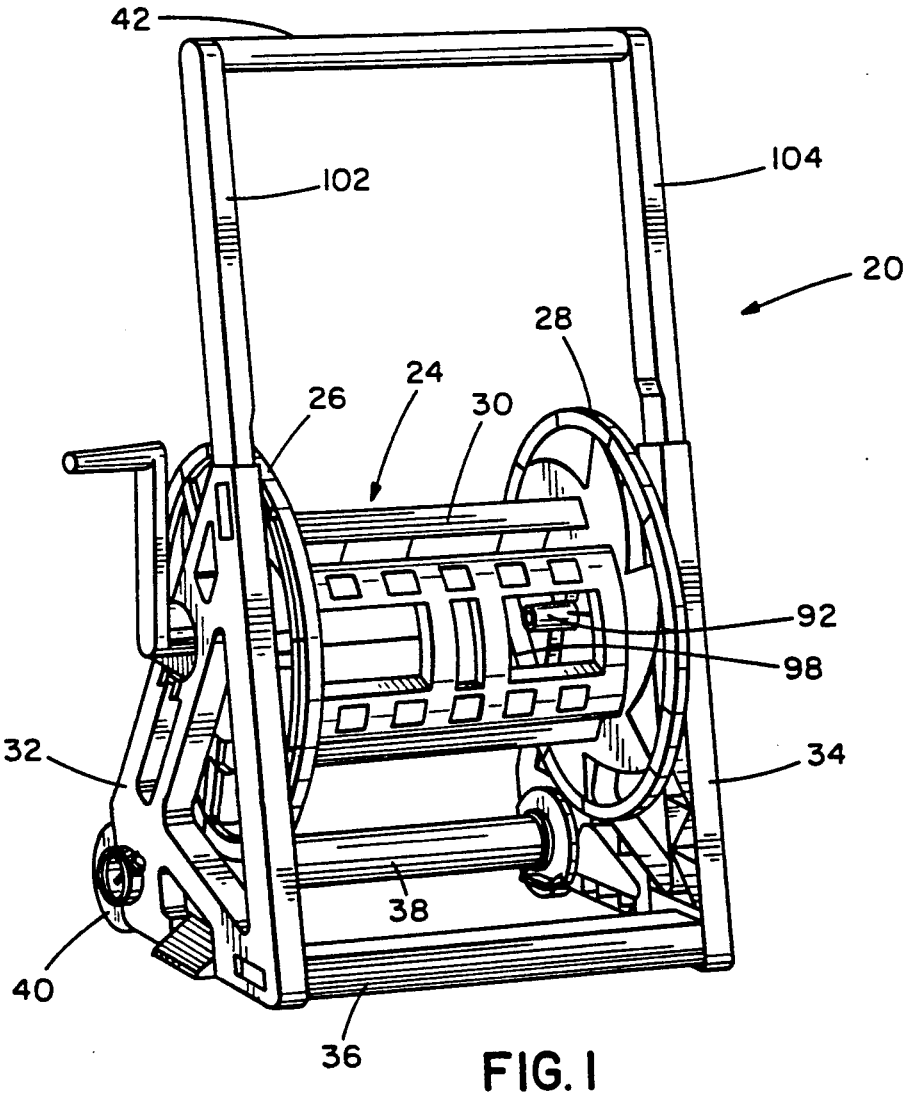
FIG. 1 is a perspective view of a portable hose cart embodying various aspects of the present invention and which is adapted for wall mounting.

Referring now to the drawings, a portable hose cart embodying various features of the present invention is generally indicated in FIGS. 1, 3, 5 and 9 by reference character 20. The cart 20 is formed of components which can be assembled in a hose reel assembly 22, shown in FIGS. 2 and 10, suitable for mounting on a wall from which extend mounting studs having enlarged heads and which are located to match the hole pattern at the base of the reel assembly, as will be discussed more fully hereinafter. The cart 20 includes a reel 24 including a pair of spaced reel flanges 26, 28 joined by a trio of cross braces 30 defining a spool upon the outer surface of which is wound a hose. The cart also includes a frame including a pair of generally vertical frame sides 32, 34 rotatably holding the reel 24, a forward reinforcing bar 36 joining the frame sides at their front, and a tube 38 (which also serves as an axle for wheels 40) joining the frame sides at their rear. A handle assembly 42 joins the frame sides at their top when the components are configured as the hose cart 20.

The frame sides, reel flanges, cross braces, reinforcing bar and handle assembly are all of one-piece molded thermoplastic construction with a preferred material being polyethylene. The tube 38 is preferably formed of extruded thermoplastic with a preferred material being polyvinylchloride. Furthermore, frame sides 32 and 34 are preferably mirror images of each other, while the reels 26 and 28 are identical and the cross braces 30 are identical.

Figure 3:
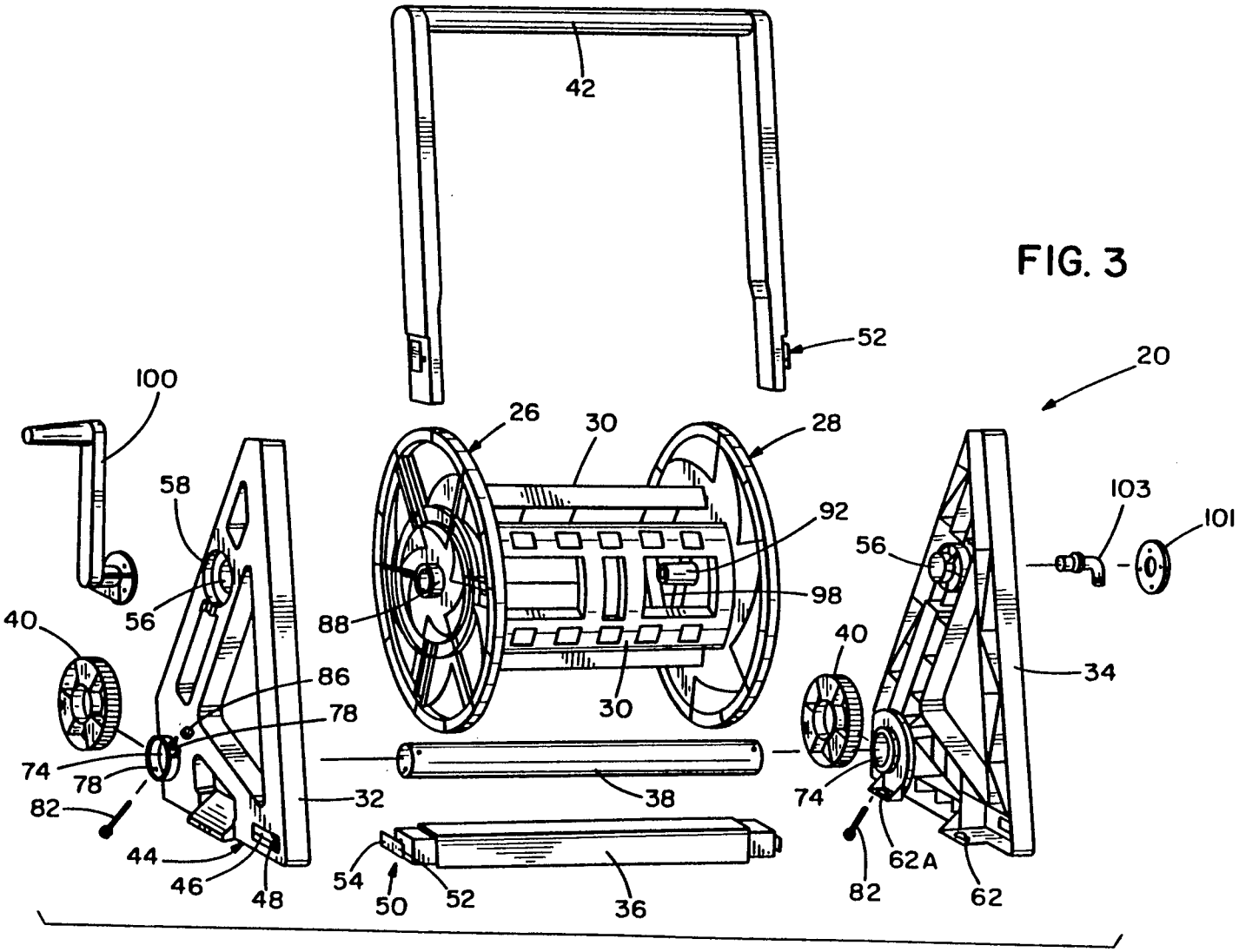
FIG. 3, similar to FIG. 1, is an exploded view of the hose cart structural components.

Major structural components of the cart such as the frame sides, reel flanges, cross braces, reinforcing bar and handle assembly are joined using releasable connector assemblies of the type taught by commonly-assigned U.S. Pat. No. 4,913,580, the teachings of which have been incorporated by reference. Referring particularly to FIG. 3, such a connector assembly includes a female component 44 molded integrally with the base of the frame side 32 and including a window 46 having a first end and a second end, an outside surface and an inside surface, a cam wall 48 disposed adjacent the first end and recessed with respect to the outside surface, and deflection means positioned adjacent the second end and the inside surface. The cam wall includes a ramp surface converging with the outside surface away from the second end.

The connector assembly also includes a male connector component 50 molded integrally with the reinforcing bar 36 and position at the end of the bar. The male connector component includes a male member for reception in the window 46 and a stem joining the male member to the reinforcing bar. The male member is somewhat resilient and has a head 52 with the undersurface for riding on the ramp surface and a tail 54 extending rearwardly of the head. Insertion of the head 52 into the window 46 and movement of the head on the cam wall 48 toward the window first end causes the deflection means to deflect the tail until the tail moves into the window. At that time the tail moves toward the outside surface of the female component 44 to retain the male member in the window thereby joining the frame side and the reinforcing bar. The components are released by pushing the deflectable latching tail 54 out of the window 46 and sliding the head 52 down the cam wall to disassemble the male and female connector components.

Figure 9:
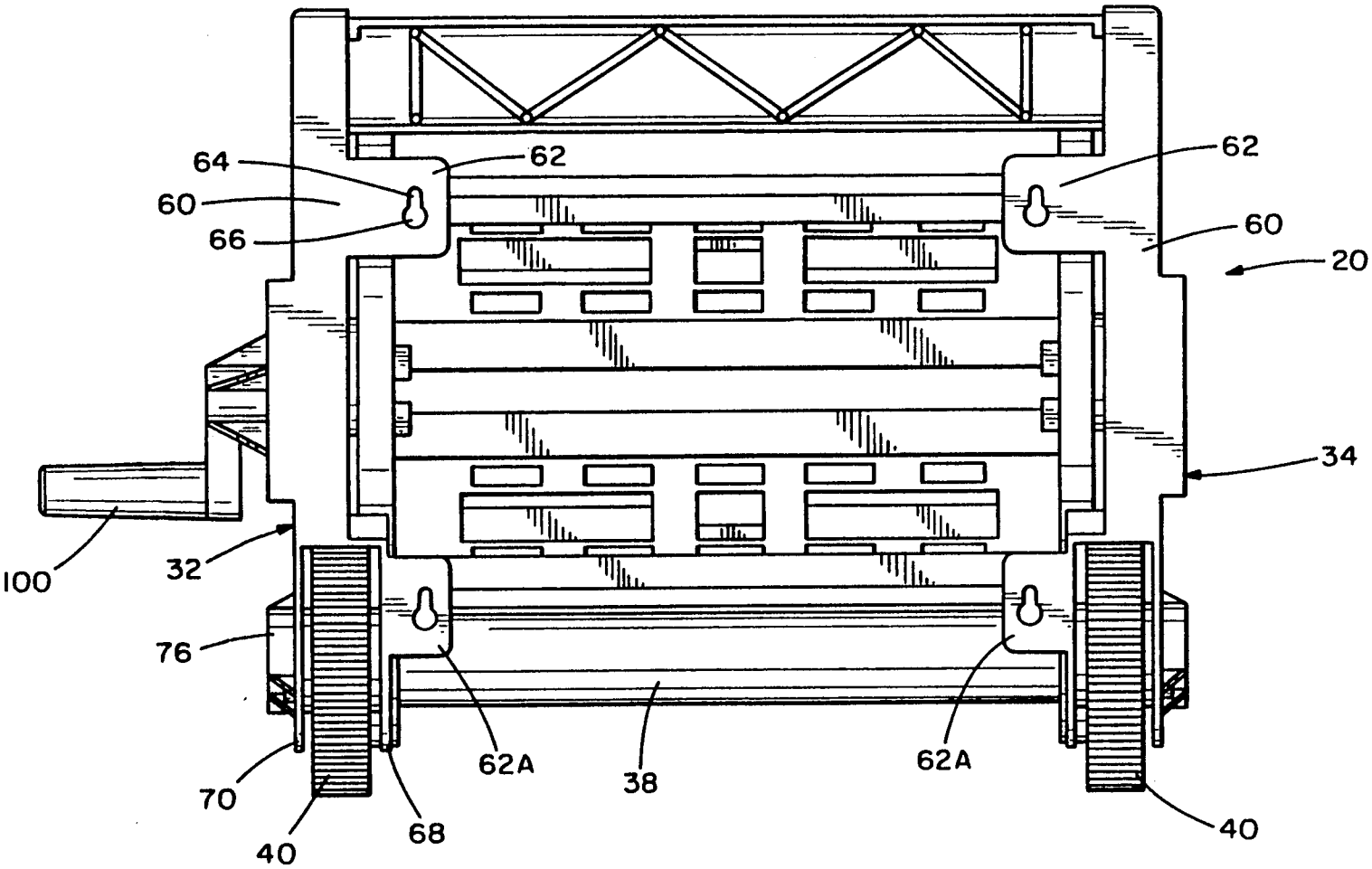
FIG. 9 is a bottom view of the hose cart with wheels held on an axle.
Figures 10, 11:
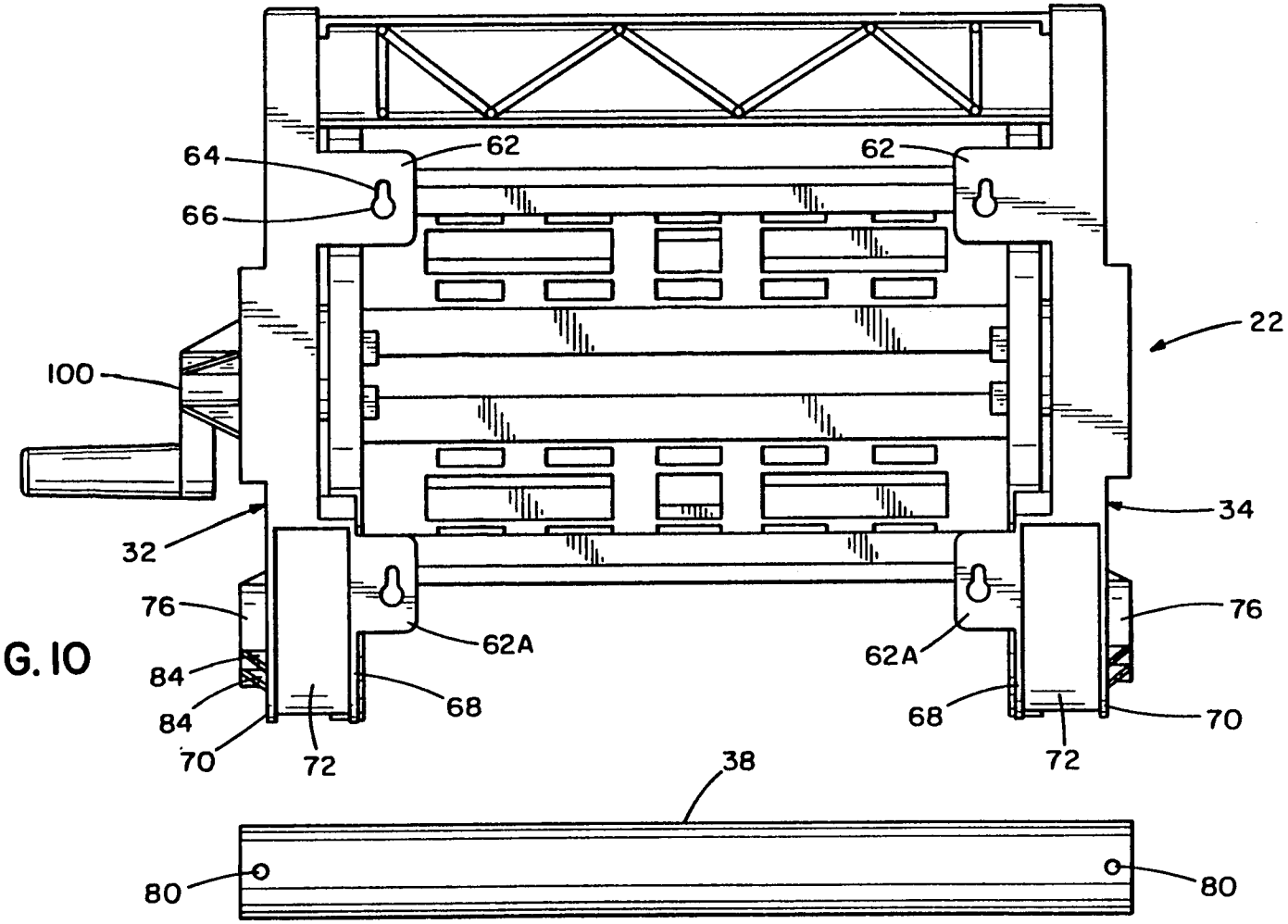
FIG. 10, similar to FIG. 9, illustrates the wheels removed so that the base of the cart can be wall mounted.
FIG. 11 is a plan view of the axle.

More specifically, each frame side 32, 34 includes a hub bearing surface 56 and an enlarged recess 58 adjoining the hub bearing surface. As best shown in FIGS. 9 and 10, each frame side also includes a bar 60 at the frame side bottom and extending between the front and rear of the frame side. The frame sides at their bottom comprise means for mounting the frame sides holding the reel 24 on the wall and this means for mounting includes a foot 62 extending inwardly from the bar 60. The foot 62 includes a stud-receiving window 64 including an enlarged opening 66 for passage of the head of the stud, with the enlarged opening positioned closer the frame side rear than the remainder of the window 64.

As best shown in FIG. 10, each frame side at its bottom rear includes an inner wall 68 and an outer wall 70 with the walls being spaced to define a cavity 72 for receiving one of the wheels 40 and for limiting the extent of movement of the wheel in the axial direction of the tube 38. As seen particularly in FIG. 5, the wheel 40 extends beneath the bottom of the frame side positioned for constant contact with a supporting surface. A similar mounting foot 62A extends inwardly from each inner wall 68. Each wall 68, 70 includes an aperture 74 (FIG. 3) for passage of the tube 38, and the outer wall 70 has a tubular extension 76 through which the tube 38 passes. The extension has diametrically opposed holes 78 and, as shown in FIG. 11, the tube also includes a bore 80 adjacent each of its ends for alignment with the holes 78 of the extension for receiving the shaft of a threaded fastener 82. The tubular extensions, apertured tube ends and fasteners constitute means for maintaining the frame sides 32, 34 spaced a predetermined distance. A pair of triangular fillets 84 flank each extension hole 78, join the extension 76 to the remainder of the frame side, and serve as a shield for either the head of the threaded fastener or the nut 86 holding the end of the fastener.

Figure 6:
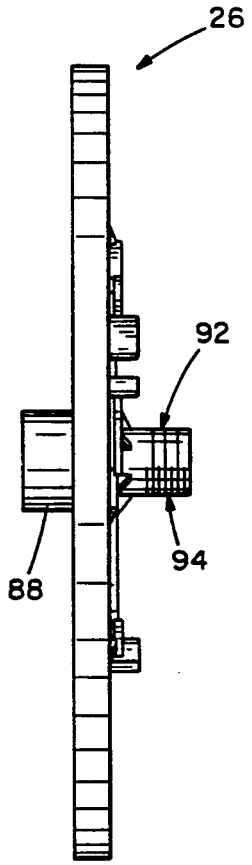
FIG. 6 is a front elevational view of one reel flange.
Figure 7:
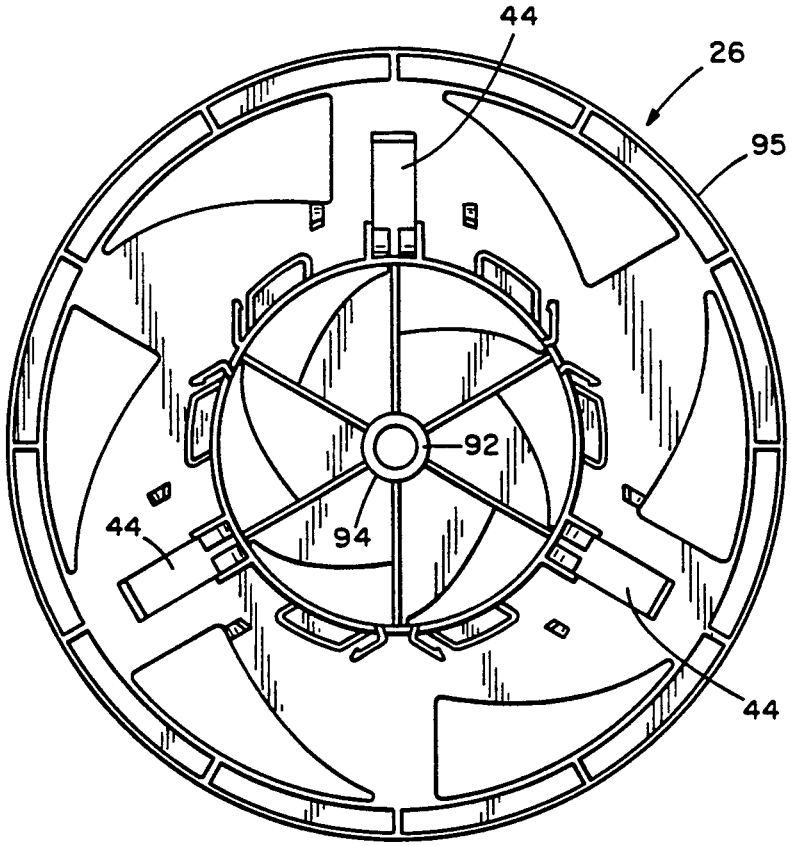
FIG. 7 is a left side elevational view of the reel flange.
Figure 8:
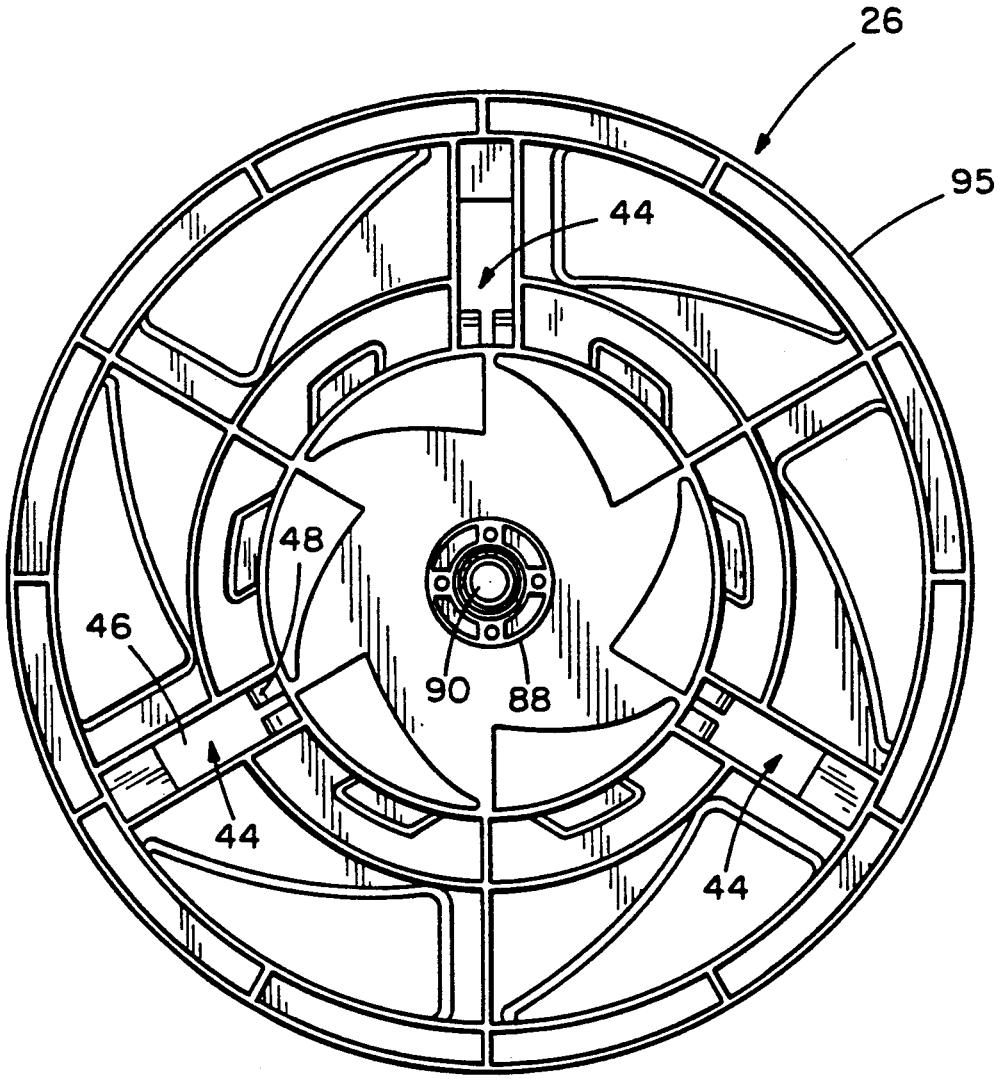
FIG. 8 is a right side elevational view of the reel flange.

Referring to FIGS. 6–8, each reel flange 26, 28 includes a hub 88 to be rotatably supported by the hub bearing surface 56 of the corresponding frame side. The hub has an axis and there is a fluid inlet bore 90 extending through the hub. Each reel flange also includes a fluid outlet tube 92 extending from the hub and being coaxial with the hub. The fluid outlet tube has an outer surface with a screw thread 94 for threadably receiving a female connector of the hose. The reel flange also has a peripheral outer rim 95, and a trio of the female components 44 of the connector assemblies are regularly spaced and located between the rim and the hub for use in joining the one flange to the other flange through the cross braces 30 thereby forming the reel 24. Each cross brace 30 has an opening 98 adjacent each of its ends of sufficient size to receive the hand of the user and to permit the user to thread the hose female connector onto the fluid outlet tube 92. It will be appreciated that the provision of the fluid outlet tube integral with the reel flange obviates the need for a separate fluid outlet tube. Such outlet tubes were typically in the form of a separate L-shaped tube having one end for attachment to the hub and with the other end extending beyond the hose support surface of the reel.

Figure 2:
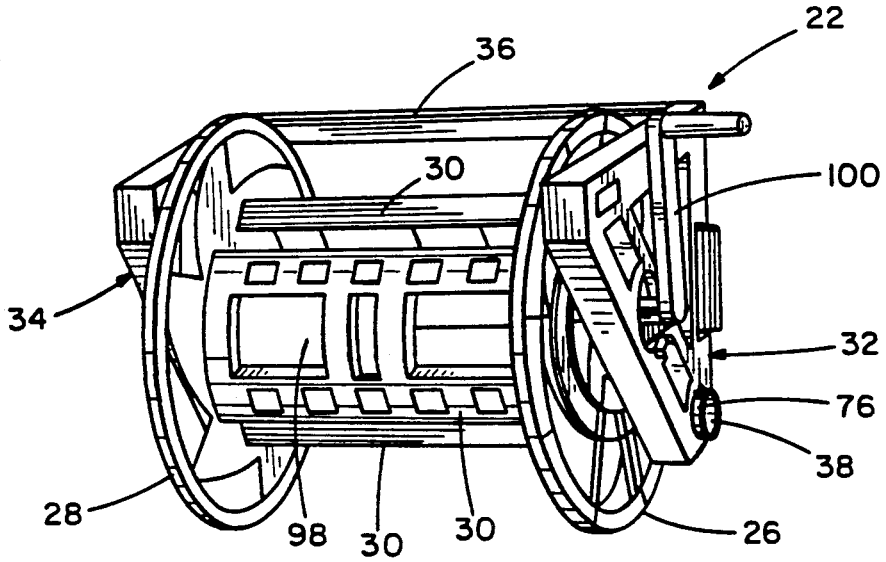
FIG. 2 is a perspective view of the hose cart of FIG. 1 after modification for wall mounting showing the basic reel and support therefore.
Figure 4:
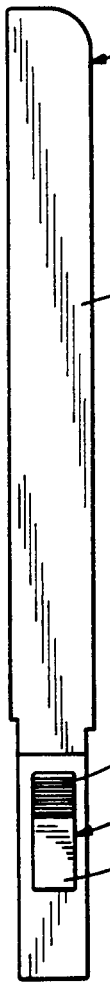
FIG. 4 is a side elevational view of a handle assembly for the hose cart.
Figure 5:
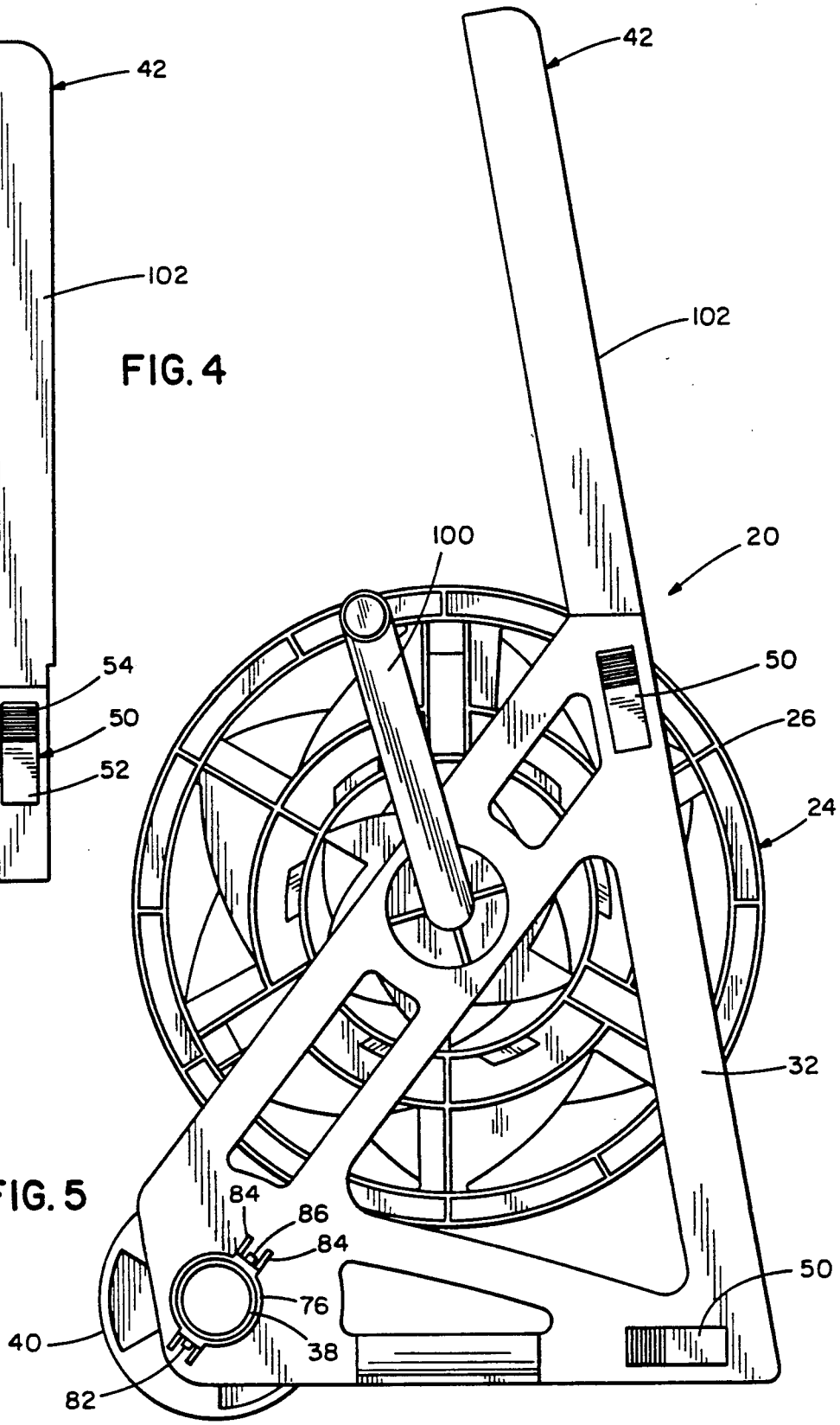
FIG. 5 is a side elevational view of the hose cart.

The hub 88 has a number of holes in its outer face which can either be used to attach a crank 100 or which can be used to attach a lock plate 101 holding in place a fluid inlet tube 103, one end of which extends inside the fluid inlet bore 90 of the hub and the other end of which is for connection to the fluid source. For further information regarding the crank or inlet tube, reference may be made to commonly-assigned U.S. Pat. No. Re. 32,510. As shown in FIGS. 1 and 4, the handle assembly 42 is U-shaped and includes a first leg 102 held adjacent to top of the frame side 32 and a second leg 104 releasably held adjacent the top of the other frame side 34.

Operation of the hose cart 20 of the present invention is as follows: Assuming that the hose cart has been assembled and that it is desired to convert it to the hose reel assembly 22 for wall mounting, the threaded fasteners 82 can be removed from the tubular extensions 76 after removal of the nuts 86. Thereafter the tube 38 is removed from the inner and outer walls 68, 70, respectively, of each frame side to permit the wheels 40 to be removed. Thereafter the tube is reinserted through the walls and the fasteners and nuts utilized to again hold the tube in place where it provides structural rigidity to maintain the frame sides properly spaced to hold the reel 24. The handle assembly 42 is easily removed from the female connector components 44 located at the top of each frame side 32, 34 by manipulation of the male connector components 50 held at the base of each handle leg 102, 104. With the wheels and the handle assembly removed, the components are now reduced to the hose reel assembly 22 of FIG. 2, which can be lifted and rotated through about 90 degrees with the tube 38 at the bottom so that the enlarged openings 66 of the mounting feet 62 are positioned to receive the heads of the mounting studs extending from the wall. After the studs are received, the reel assembly 22 is simply shifted downwardly causing the shafts of the studs to enter the windows 64 of each mounting foot resulting in the reel assembly being held firmly on the wall. Should it be desired to reconvert the hose reel assembly 22 to the hose cart 20, the hose reel assembly can be simply lifted from the wall and the wheels and handle assembly replaced.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable hose cart for movement between a storage location and a use location, said cart comprising;

a first frame side and a second frame side, each side frame side having a top, a bottom and a hub bearing surface disposed between said top and bottom;

a reel disposed between said frame sides and including a first reel flange having a hub rotatably supported by the hub bearing surface of said first frame side, a second reel flange having a hub rotatably supported by the hub bearing surface of said second frame side, and a plurality of cross braces joining said reel flanges and defining a support surface for the winding of a hose;

a demountable upstanding handle having a first leg detachably secured to said first frame side and a second leg detachably secured to said second frame side;

an axle extending between and detachably secured to each frame side adjacent the bottom of each frame side, said axle maintaining said frame sides spaced a predetermined distance apart;

a pair of wheels journaled on said axle with one of said wheels adjacent to each frame side and extending beneath the bottom thereof, each frame side at its bottom having mounting means for attaching said frame sides to a wall after detaching said handle and said wheels.

2. A hose cart as set forth in claim 1 wherein each frame side has a front and a rear, said axle being positioned adjacent the rear of each frame side, said cart further having a forward reinforcing bar joining said frame sides adjacent their front ends and bottoms.

3. A hose cart as set forth in claim 1 wherein each of said frame sides has adjacent its bottom spaced inner and outer walls defining a cavity for receiving one of said wheels and limiting the axial movement of the wheel on said axle.

4. A hose cart as set forth in claim 3 wherein each said wall of each said frame side is apertured for passage of said axle therethrough, and said outer wall extends outwardly from its axle aperture as tubular extension to receive said axle, said tubular extension and said axle having alignable holes to receive a removable fastener.

5. A hose cart as set forth in claim 1 wherein each frame side has a front and a rear, each frame side bottom includes a bar extending between said front and said rear, said means for mounting the frame sides on a wall comprises a foot extending inwardly from each said bar, and each foot has therein a keyhole slot having its enlarged end disposed toward the rear of said frame side.

6. A hose cart as set forth in claim 1 wherein each of said frame sides is of integral molded thermoplastic construction and is a substantial mirror image of the other, and each leg of said handle is received within a socket molded in its associated frame side.

7. A hose cart as set forth in claim 1 wherein said reel flanges are each of integrally molded thermoplastic construction and are identical.

8. A hose cart as set forth in claim 7 wherein the hub of each said reel flange has a fluid inlet bore extending through said hub and terminates in a threaded outlet nipple extending from said hub for receiving the female connector of a hose, at least one of said cross braces having an opening of sufficient size to permit the user to insert the hose and connect said female connector to said nipple.

9. A hose cart as set forth in claim 8 further comprising a hand crank connected to the hub of one of said reel flanges, and an inlet tube extending into the fluid inlet bore of the hub of the other.

10. A reel flange for use in forming a reel of a hose storage device, said flange being of one-piece molded thermoplastic construction and comprising:

a central hub having an axis and a fluid passage extending through said hub;

a fluid outlet tube extending from said hub, said tube having an outer surface with a screw thread for threadably receiving the female connector of a hose;

a peripheral outer rim; and a plurality of regularly spaced connector elements disposed between said rim and said hub for use in joining said flange to a second flange to form said reel.

11. A reel flange as set forth in claim 10 wherein said fluid outlet tube is coaxial with said hub.

12. A hose reel for receiving and holding a hose and comprising:

a) a pair of identical, opposed reel flanges each being of one-piece molded thermoplastic construction and each including a central journal hub having a fluid passage extending through said hub, a fluid outlet tube extending from said hub toward the opposite reel flange and having an outer screw thread for threadably receiving a female connector of a hose, a peripheral outer rim, and a plurality of regularly spaced connector elements disposed between said rim and said hub; and b) a plurality of cross braces, of integrally molded thermoplastic construction, joining said reel flanges and defining a support surface for said hose, each said cross brace having at each end a connector element complementary to the connector elements of said reel flanges for securing said cross braces to said reel flanges to form a reel.

13. A hose reel as set forth in claim 12 wherein the fluid outlet tube of each reel of flange is coaxial with the hub of that reel flange.

14. A hose reel as set forth in claim 12 wherein at least one of said cross braces defines an opening of sufficient size to permit the user to insert said hose inside said support surface and to connect said female coupling to said outlet tube of one of said reel flanges.

15. The hose reel of claim 12 wherein the connector elements of said cross braces and reel flanges constitute a connector assembly of a male component and a mateable female component, each said female connector component including a window having a first end and a second end, an outside surface and an inside surface, a cam wall disposed adjacent said first end of said window and recessed with respect to said outside surface, and deflection means disposed adjacent said second end of said window and said inside surface, said cam wall including a ramp surface converging with said outside surface away from said second end of said window; and each said male connector component including a male member for reception in said window and a stem joining said male member and the remainder of a component of the hose reel, said male member being resilient and having a head with an undersurface for riding on said ramp surface and a tail extending rearwardly of said head, said head and tail having generally coplanar outside surfaces, insertion of said head into said window and movement of said head on said cam wall toward said window first end causing said deflection means to deflect said tail until said tail moves into said window past said deflection means at which time said tail moves toward said outside surface of said female component to retain said male member in said window thereby joining one end of a cross brace to a reel flange.

* * * * *

UNITED STATES PATENT AND TRADEMARK OFFICE

CERTIFICATE OF CORRECTION

PATENT NO. : 5,056,553

DATED : October 15, 1991

INVENTOR(S) : Whitehead et al.

It is certified that error appears in the above-identified patent and that said Letters Patent is hereby corrected as shown below:

In the Abstract [57], line 7, change "definging" to --defining--.

In the Abstract [57], lines 11-12, change "functioninbg" to --functioning--.

Column 3, Line 28, change "polyethylene" to --polypropylene--.

Claim 1, Column 5, Line 54, change "side" (third occurrence) to --said--.

Signed and Sealed this

First Day of June, 1993

*Attest:*

Michael K. Kirk

MICHAEL K. KIRK

*Attesting Officer*

*Acting Commissioner of Patents and Trademarks*